US011830655B2

(12) United States Patent
Yang et al.

(10) Patent No.: US 11,830,655 B2
(45) Date of Patent: Nov. 28, 2023

(54) COIL COMPONENT

(71) Applicant: SAMSUNG ELECTRO-MECHANICS CO., LTD., Suwon-si (KR)

(72) Inventors: Ju Hwan Yang, Suwon-si (KR); Joung Gul Ryu, Suwon-si (KR); Ji Man Ryu, Suwon-si (KR); Byung Soo Kang, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 486 days.

(21) Appl. No.: 16/990,218

(22) Filed: Aug. 11, 2020

(65) Prior Publication Data

US 2021/0335532 A1 Oct. 28, 2021

(30) Foreign Application Priority Data

Apr. 27, 2020 (KR) ..... 10-2020-0050608

(51) Int. Cl.
*H01F 27/28* (2006.01)
*H01F 41/04* (2006.01)
*H01F 27/29* (2006.01)

(52) U.S. Cl.
CPC ..... *H01F 27/2804* (2013.01); *H01F 27/29* (2013.01); *H01F 41/041* (2013.01); *H01F 2027/2809* (2013.01)

(58) Field of Classification Search
CPC ..... H01F 27/2804; H01F 17/0013; H01F 17/0006; H01F 2027/2809; H01F 5/003; H01F 27/29; H01F 27/292
(Continued)

(56) References Cited

U.S. PATENT DOCUMENTS

2009/0243781 A1* 10/2009 Nomura ..... H01F 41/043 336/200
2014/0009254 A1* 1/2014 Ohkubo ..... H01F 17/0033 336/192
(Continued)

FOREIGN PATENT DOCUMENTS

JP 2015228477 A * 12/2015 ..... H01F 17/0013
JP 2015228479 A * 12/2015 ..... H01F 17/0013
(Continued)

OTHER PUBLICATIONS

Korean Office Action dated Sep. 8, 2021 issued in Korean Patent Application No. 10-2020-0050608 (with English translation).

*Primary Examiner* — Tszfung J Chan
(74) *Attorney, Agent, or Firm* — Morgan, Lewis & Bockius LLP

(57) ABSTRACT

A coil component includes a body, a support substrate disposed in the body, and a coil portion including a first coil pattern on one surface of the support substrate, a first lead-out pattern extending from the first coil pattern to an end surface of the body, and a second lead-out pattern disposed on the one surface of the support substrate to be spaced apart from the first coil pattern and extending to another end surface of the body. A reinforcing pattern portion is disposed between each lead-out pattern and the one surface of the support substrate, first and second slit portions are disposed in edge portions of the body and respectively expose the first and second lead-out patterns, and first and second external electrodes are respectively disposed on the inner surfaces of the first and second slit portions and respectively connected to the first and second lead-out patterns.

20 Claims, 12 Drawing Sheets

(58) Field of Classification Search
USPC ..... 336/200, 232
See application file for complete search history.

(56) References Cited

U.S. PATENT DOCUMENTS

| | | | | |
|---|---|---|---|---|
| 2015/0035634 | A1* | 2/2015 | Nakamura | H01F 41/046 336/170 |
| 2015/0048915 | A1* | 2/2015 | Yoon | H01F 17/0013 336/192 |
| 2016/0336105 | A1* | 11/2016 | Choi | H01F 27/255 |
| 2020/0013540 | A1 | 1/2020 | Kang et al. | |
| 2020/0335254 | A1* | 10/2020 | Park | H01L 23/645 |

FOREIGN PATENT DOCUMENTS

| | | | | |
|---|---|---|---|---|
| KR | 10-2014-0005088 | A | 1/2014 | |
| KR | 10-2015-0033343 | A | 4/2015 | |
| KR | 10-1548862 | B1 | 8/2015 | |
| KR | 1548862 | B1 * | 8/2015 | H01F 17/0013 |
| KR | 10-2016-0057785 | A | 5/2016 | |
| KR | 2016057785 | A * | 5/2016 | |
| KR | 10-2020-0005011 | A | 1/2020 | |

* cited by examiner

COIL COMPONENT

CROSS-REFERENCE TO RELATED APPLICATION(S)

This application claims benefit of priority to Korean Patent Application No. 10-2020-0050608 filed on Apr. 27, 2020 in the Korean Intellectual Property Office, the disclosure of which is incorporated herein by reference in its entirety.

BACKGROUND

1. Field

The present disclosure relates to a coil component.

2. Description of Related Art

An inductor, a coil component, is a typical passive electronic component used in electronic devices, along with a resistor and a capacitor.

As electronic devices gradually become high-performance and smaller, the number of electronic components used in such electronic devices may increase, and the electronic components may be miniaturized.

External electrodes of the coil component may be usually formed on two surfaces of a body opposing each other. In this case, an overall length or width of the coil component may increase due to thicknesses of the external electrodes. In addition, when the coil component is mounted on a mounting substrate, the external electrodes of the coil component may be in contact with another component disposed adjacent to the mounting substrate, to generate an electrical short.

SUMMARY

An aspect of the present disclosure is to more stably support a support substrate during a manufacturing process.

Another aspect of the present disclosure is to provide a coil component capable of minimizing loss of a body.

According to an aspect of the present disclosure, a coil component includes a body having one surface and another surface opposing each other, a support substrate disposed in the body, and a coil portion including a first coil pattern disposed on one surface of the support substrate facing the one surface of the body, a first lead-out pattern extending from the first coil pattern to an end surface of the body, and a second lead-out pattern disposed on the one surface of the support substrate to be spaced apart from the first coil pattern and extending to another end surface of the body. A reinforcing pattern portion is disposed between each of the first and second lead-out patterns and the one surface of the support substrate, first and second slit portions are respectively disposed in edge portions of the one surface of the body and respectively expose the first and second lead-out patterns from inner surfaces of the first and second slit portions, and first and second external electrodes are respectively disposed on the inner surfaces of the first and second slit portions and respectively connected to the first and second lead-out patterns.

According to another aspect of the present disclosure, a coil component includes a body having one surface and another surface opposing each other, a support substrate disposed in the body, and a coil portion including a first coil pattern disposed on one surface of the support substrate facing the one surface of the body, a first lead-out pattern extending from the first coil pattern to an end surface of the body, and a second lead-out pattern disposed on the one surface of the support substrate to be spaced apart from the first coil pattern and extending to another end surface of the body. First and second slit portions are respectively formed in edge portions of the one surface of the body and respectively expose the first and second lead-out patterns from inner surfaces of the first and second slit portions, and first and second external electrodes are respectively disposed on the inner surfaces of the first and second slit portions and respectively connect to the first and second lead-out patterns. A thickness of each of the first and second lead-out patterns is greater than a thickness of the first coil pattern.

According to a further aspect of the present disclosure, a coil component includes a body, a support substrate disposed in the body, and a coil portion including a first coil pattern disposed on one surface of the support substrate, and first and second lead-out patterns extending between the first coil pattern and respective end surfaces of the body. First and second reinforcing pattern portions are formed of a conductive material, the first reinforcing pattern portion being disposed between the one surface of the support substrate and only the first lead-out pattern, from among the first lead-out pattern and the first coil pattern, and the second reinforcing pattern portion being disposed between the one surface of the support substrate and only the second lead-out pattern, from among the second lead-out pattern and the first coil pattern.

BRIEF DESCRIPTION OF LEAD-OUTS

The above and other aspects, features, and advantages of the present disclosure will be more clearly understood from the following detailed description, taken in conjunction with the accompanying drawings, in which.

DETAILED DESCRIPTION

Figure 1:
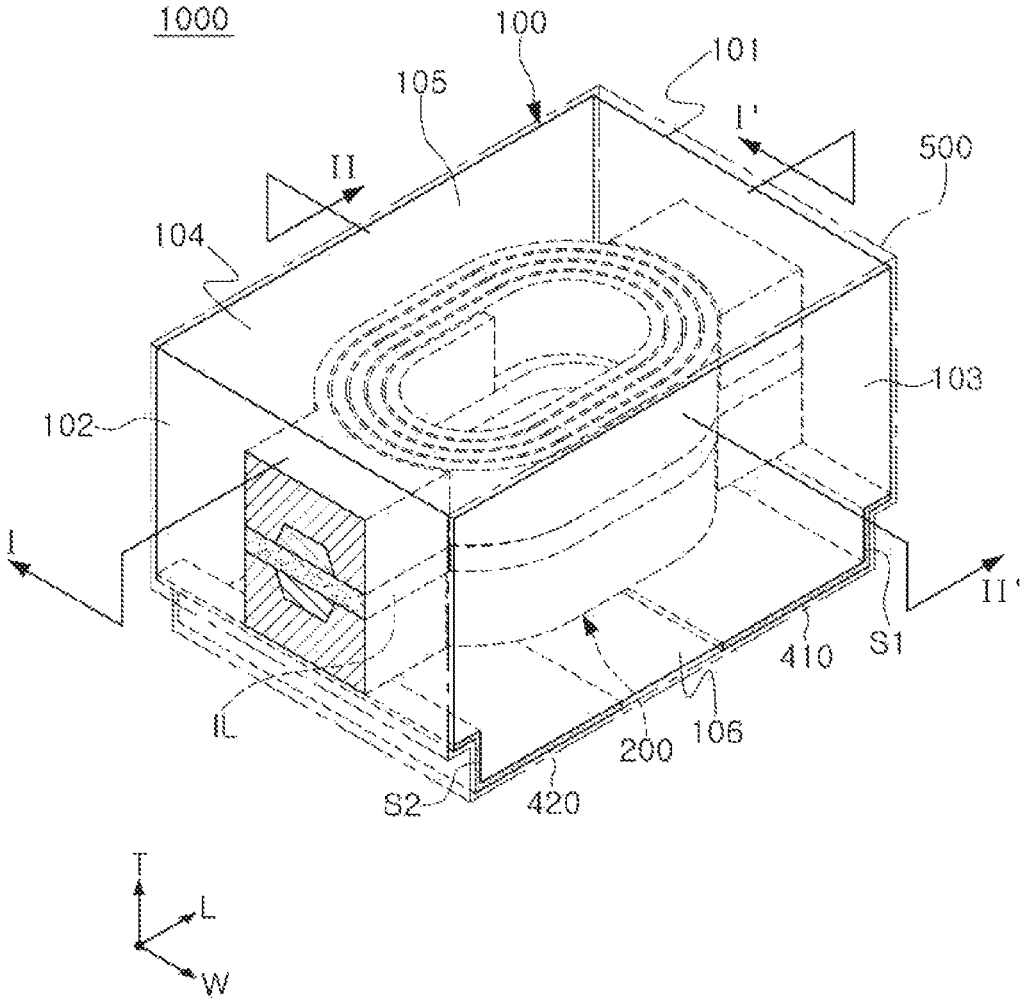
FIG. 1 is a view schematically illustrating a coil component according to a first embodiment of the present disclosure.

The terms used in the description of the present disclosure are used to describe a specific illustrative embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include configurations in which other element(s) is/are interposed between the elements such that the elements are also in contact with the other component(s).

Sizes and thicknesses of elements illustrated in the drawings are indicated as examples for ease of description, and the present disclosure is not limited thereto.

In the drawings, an L direction may be defined as a first direction or a length (longitudinal) direction, a W direction may be defined as a second direction or a width direction, a T direction may be defined as a third direction or a thickness direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

First Embodiment

Figure 2:
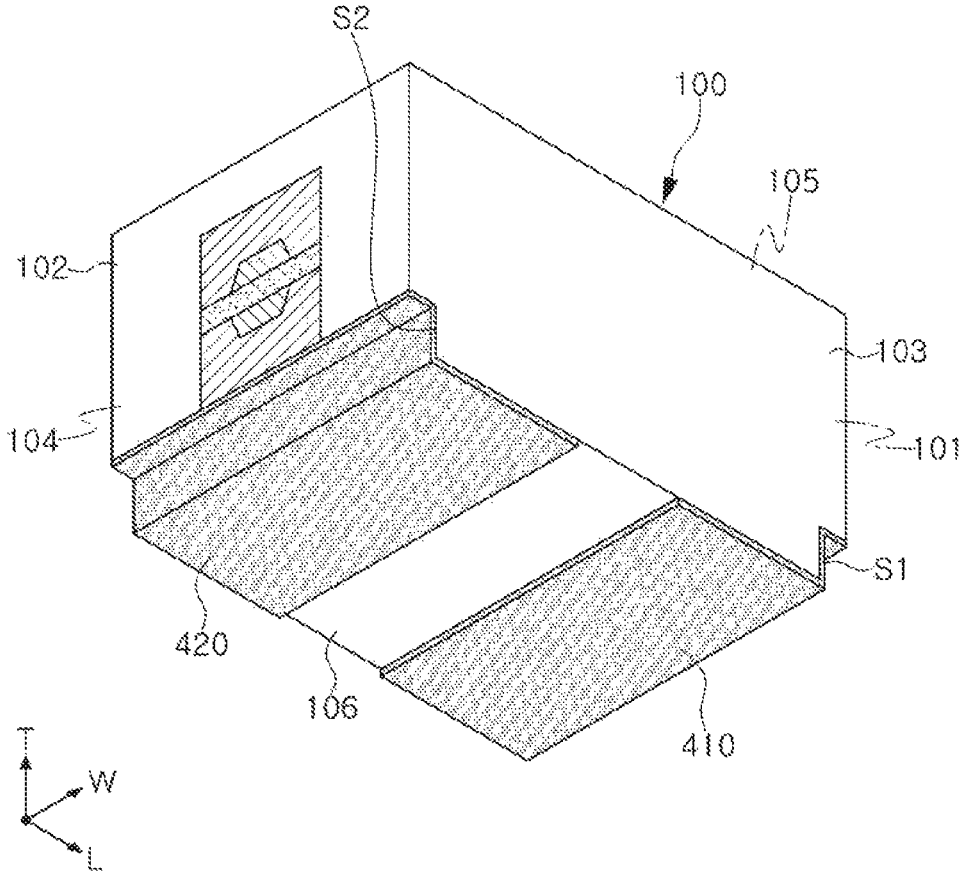
FIG. 2 is a view of the coil component of FIG. 1, except for some configurations, when viewed from below.
Figure 3:
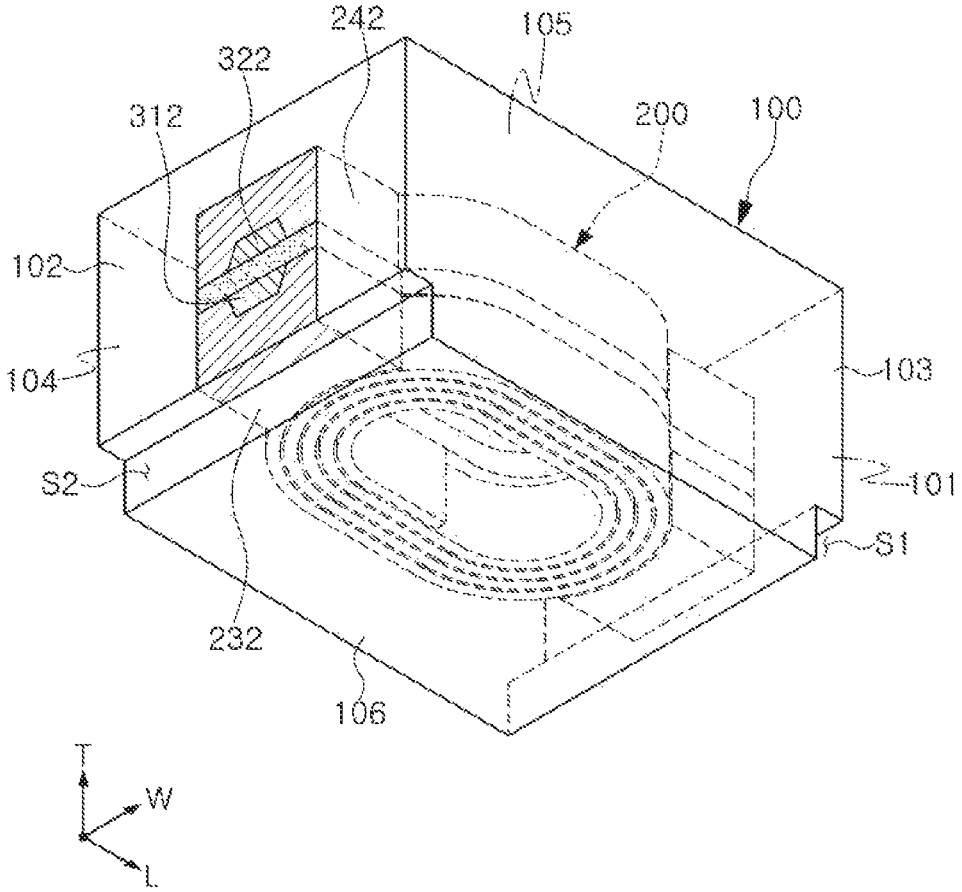
FIG. 3 is a view of the coil component of FIG. 2, except for some configurations.
Figure 4:
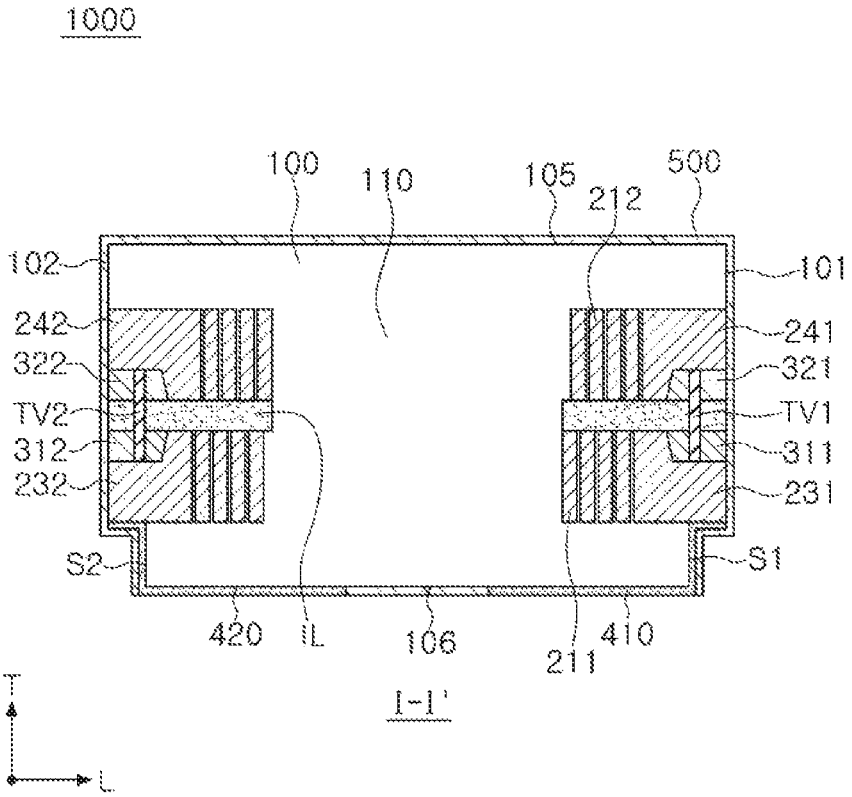
FIG. 4 is a view illustrating a cross-section taken along line I-I' of the coil component of FIG. 1.
Figure 5:
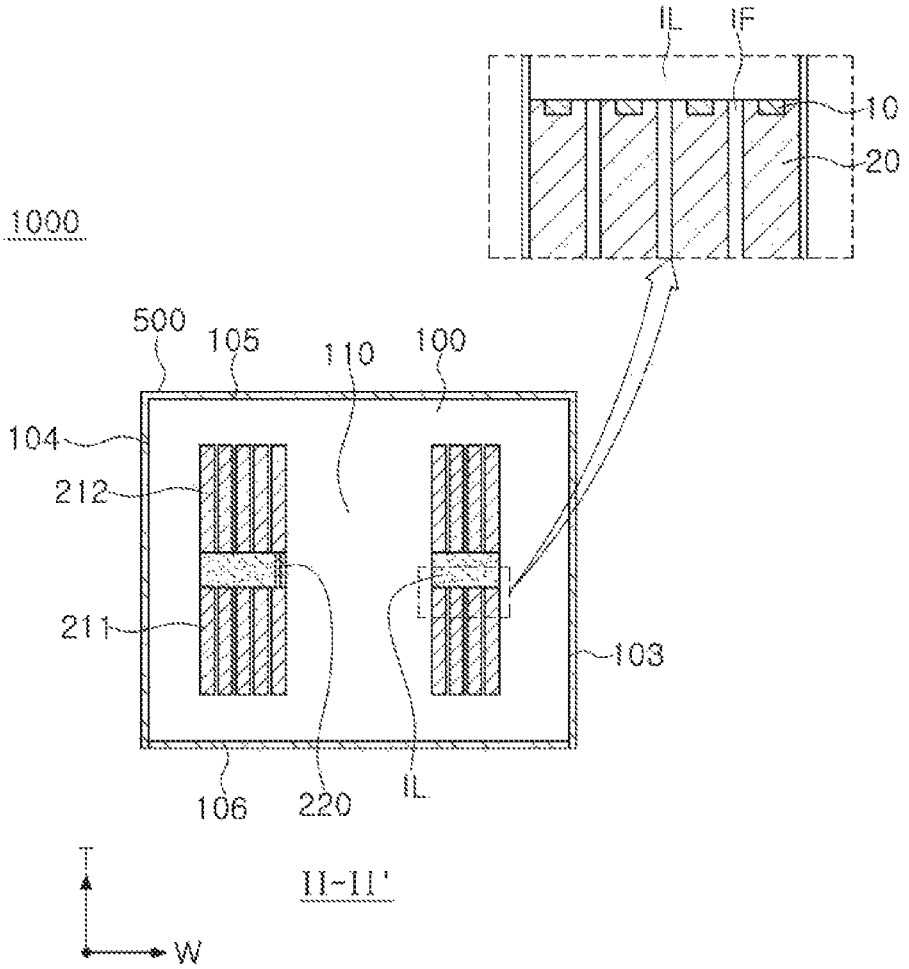
FIG. 5 is a view illustrating a cross-section taken along line II-II' of the coil component of FIG. 1.
Figure 6:
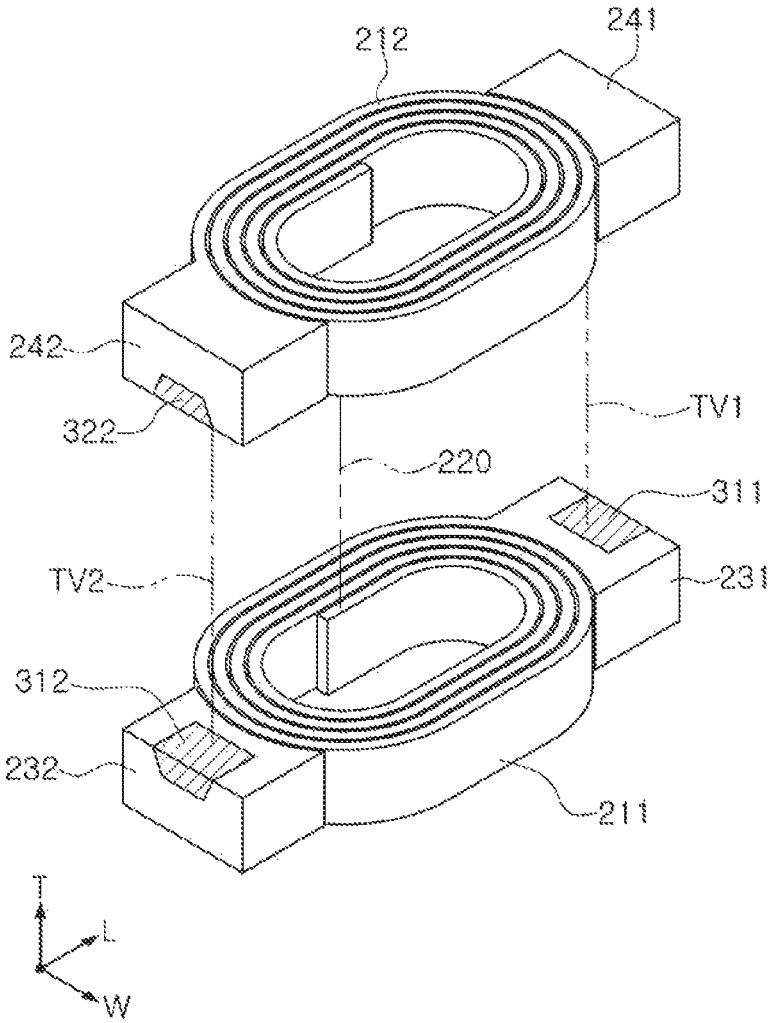
FIG. 6 is an exploded view of a coil portion.

FIG. 1 is a view schematically illustrating a coil component according to a first embodiment of the present disclosure. FIG. 2 is a view of the coil component of FIG. 1, except for some configurations, when viewed from below. FIG. 3 is a view of the coil component of FIG. 2, except for some configurations. FIG. 4 is a view illustrating a cross-section taken along line I-I' of the coil component of FIG. 1. FIG. 5 is a view illustrating a cross-section taken along line II-II' of the coil component of FIG. 1. FIG. 6 is an exploded view of a coil portion. In order to help in gaining an understanding of the present disclosure, FIG. 2 illustrates the coil component of FIG. 1 having a surface insulation layer removed therefrom, when viewed from below. In addition, FIG. 3 illustrates a configuration of FIG. 2, excluding an external electrode.

Referring to FIGS. 1 to 6, a coil component 1000 according to a first embodiment of the present disclosure may include a body 100, a support substrate IL, slit portions S1 and S2, a coil portion 200, and external electrodes 410 and 420.

The body 100 may form an exterior of the coil component 1000 according to this embodiment, and the support substrate IL and the coil portion 200 may be embedded therein.

The body 100 may be formed to have a hexahedral shape overall.

Referring to FIGS. 1 to 5, the body 100 may include a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. Each of the first to fourth surfaces 101, 102, 103, and 104 of the body 100 may correspond to wall surfaces of the body 100 connecting the fifth surface 105 and the sixth surface 106 of the body 100. Hereinafter, both end surfaces of the body 100 may refer to the first surface 101 and the second surface 102 of the body 100, and both side surfaces of the body 100 may refer to the third surface 103 and the fourth surface 104 of the body 100. In addition, one surface of the body 100 may refer to the sixth surface 106 of the body 100, and the other surface of the body 100 may refer to the fifth surface 105 of the body 100.

The body 100 may, for example, be formed such that the coil component 1000 according to this embodiment in which the external electrodes 410 and 420 to be described later are formed has a length of 2.0 mm, a width of 1.2 mm, and a thickness of 0.65 mm, but is not limited thereto.

The body 100 may include a magnetic material and a resin. Specifically, the body 100 may be formed by stacking one or more magnetic composite sheets including a resin and a magnetic material dispersed in the resin. The body 100 may have a structure, other than a structure in which the magnetic material may be dispersed in the resin. For example, the body 100 may be made of a magnetic material such as ferrite.

The magnetic material may be a ferrite powder particle or a metal magnetic powder particle.

Example of the ferrite powder particle may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder particle may include one or more selected from the group consisting of iron (Fe), silicon (Si), chromium (Cr), cobalt (Co), molybdenum (Mo), aluminum (Al), niobium (Nb), copper (Cu), boron (B), zirconium (Zr), hafnium (Hf), phosphorus (P), and nickel (Ni). For example, the metal magnetic powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic powder particles may be amorphous or crystalline. For example, the metal magnetic powder particles may be a Fe—Si—B—Cr-based amorphous alloy powder particle, but is not limited thereto.

The metallic magnetic powder particles may have an average diameter of about 0.1 μm to 30 μm, but are not limited thereto.

The body 100 may include two or more types of magnetic materials dispersed in resin. In this case, the term "different types of magnetic materials" means that the magnetic materials dispersed in the resin are distinguishable from each other by average diameter, composition, crystallinity, and a shape.

The resin may include an epoxy, a polyimide, a liquid crystal polymer, or the like, in single form or in combined form, but is not limited thereto.

The body 100 may include a core 110 passing through the coil portion 200, which will be described later. The core 110 may be formed by filling a through-hole of the coil portion 200 with a magnetic composite sheet, but is not limited thereto.

The support substrate IL may be disposed in the body 100. The support substrate IL may support the coil portion 200 to be described later.

The support substrate IL may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the support substrate IL may be formed of a material such as prepreg, Ajinomoto Build-up Film (ABF), FR-4, a bismaleimide triazine (BT) resin, a photoimageable dielectric (PID), and the like, but are not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate IL is formed of an insulating material including a reinforcing material, the support substrate IL may provide better rigidity. When the support substrate IL is formed of an insulating material not containing glass fibers, the support substrate IL may be advantageous for reducing a thickness of the overall coil portion 200. When the support substrate IL is formed of an insulating material containing a photosensitive insulating resin, the number of processes for forming the coil portion 200 may be reduced. Therefore, it may be advantageous in reducing production costs, and a fine via may be formed.

A thickness of the support substrate IL may be, for example, 10 μm or more and 50 μm or less, but is not limited thereto.

The slit portions S1 and S2 may be formed in edge portions of the sixth surface 106 of the body 100. Specifically, the slit portions S1 and S2 may be formed along an edge portion between each of the first and second surfaces 101 and 102 of the body 100 and the sixth surface 106 of the body 100. For example, a first slit portion S1 may be formed along an edge portion between the first surface 101 of the body 100 and the sixth surface 106 of the body 100, and a second slit portion S2 may be formed along an edge portion between the second surface 102 of the body 100 and the sixth surface 106 of the body 100. The slit portions S1 and S2 may have a shape extending from the third surface 103 of the body 100 to the fourth surface 104 of the body 100. The slit portions S1 and S2 may not extend to the fifth surface 105 of the body 100. For example, the slit portions S1 and S2 may not pass through the body 100 in the thickness direction T of the body 100.

The slit portions S1 and S2 may be formed by performing pre-dicing on one surface of a coil bar along an conceptual boundary line that matches the width direction of each of the coil components, among conceptual boundary lines that individualize each of the coil components, in a state of the coil bar, e.g., in a state before each of the coil components is individualized. A depth of the pre-dicing may be adjusted such that the lead-out patterns 231 and 232, which will be described later, are exposed from inner surfaces of the slit portions S1 and S2. The inner surfaces of the slit portions S1 and S2 may have inner walls, substantially parallel to the first and second surfaces 101 and 102 of the body 100, and lower surfaces connecting the inner walls and the first and second surfaces 101 and 102 of the body 100. Hereinafter, for convenience of description, the slit portions S1 and S2 will be described as having an inner wall and a lower surface, but the scope of the present disclosure is not limited thereto. As an example, the inner surface of the first slit portion S1 may be formed such that a shape of a cross-section of the first slit portion S1 has a shape of a curve connecting the first surface 101 and the sixth surface 106 of the body 100.

The inner surfaces of the slit portions S1 and S2 may also correspond to a surface of the body 100, but in this specification, the inner surfaces of the slit portions S1 and S2 may be distinguished from a surface of the body 100 for the convenience of understanding and explanation of the present disclosure.

The coil portion 200 may be embedded in the body 100 to manifest characteristics of the coil component. For example, when the coil component 1000 according to this embodiment is used as a power inductor, the coil portion 200 may function to stabilize the power supply of an electronic device by storing an electric energy as a magnetic field and maintaining an output voltage.

The coil portion 200 may include coil patterns 211 and 212, lead-out patterns 231 and 232, auxiliary lead-out patterns 241 and 242, and a connection via 220.

Referring to FIGS. 4 to 6, based on the directions of FIGS. 4 and 5, a first coil pattern 211, a first lead-out pattern 231, and a second lead-out pattern 232 may be arranged on the lower surface of the support substrate IL facing the lower surface (sixth surface 106) of the body 100, and a second coil pattern 212, a first auxiliary lead-out pattern 241, and a second auxiliary lead-out pattern 242 may be arranged on the upper surface of the support substrate IL opposing the lower surface of the support substrate IL. On the lower surface of the support substrate IL, the first coil pattern 211 may be in contact with and connected (e.g., directly connected) to the first lead-out pattern 231, and the first coil pattern 211 and the first lead-out pattern 231 may be arranged to be spaced apart from (and not in direct contact with) the second lead-out pattern 232. The first lead-out pattern 231 may be formed to extend from an outermost turn of the first coil pattern 211 to the side surface 101 of the body 100. On the upper surface of the support substrate IL, the second coil pattern 212 may be in contact with and connected (e.g., directly connected) to the second auxiliary lead-out pattern 242, and the second coil pattern 212 and the second auxiliary lead-out pattern 242 may be arranged to be spaced apart from (and not in direct contact with) the first auxiliary lead-out pattern 241. The second auxiliary lead-out pattern 242 may be formed to extend from an outermost turn of the second coil pattern 212 to the side surface 102 of the body 100. The connection via 220 may pass through the support substrate IL, to be in contact with and connected to an innermost turn of the first coil pattern 211 and an innermost turn of the second coil pattern 212. The first lead-out pattern 231 and the first auxiliary lead-out pattern 241 may be connected to each other by a first reinforcing pattern portion 311, a first auxiliary reinforcing pattern portion 321, and a first through-via TV1, which will be described later. The second lead-out pattern 232 and the second auxiliary lead-out pattern 242 may be connected to each other by a second reinforcing pattern portion 312, a second auxiliary reinforcing pattern portion 322, and a second through-via TV2, which will be described later. By doing so, the coil portion 200 may function as one coil as a whole.

Each of the first coil pattern 211 and the second coil pattern 212 may be provided to have a planar spiral shape having at least one turn formed about the core 110. For example, the first coil pattern 211 may form at least one turn about the core 110 on one surface of the support substrate IL.

The first lead-out pattern 231 may be exposed from a lower surface of the first slit portion S1, and the second lead-out pattern 232 may be exposed from a lower surface of the second slit portion S2. The external electrodes 410 and 420, which will be described later, may be formed on the lower and inner walls of the slit portions S1 and S2. Since the lead-out patterns 231 and 232 are exposed on the lower surfaces of the slit portions S1 and S2, the lead-out patterns 231 and 232 and the external electrodes 410 and 420 may be in contact with and connected to each other.

Regions exposed from the lower surfaces of the slit portions S1 and S2, among surfaces of the lead-out patterns 231 and 232 facing the sixth surface 106 of the body 100, may have higher surface roughness, compared to other surfaces of the lead-out patterns 231 and 232. For example, when the lead-out patterns 231 and 232 are formed by electroplating, and the slit portions S1 and S2 are then formed on the body 100, a dicing tip may be in contact with a portion of the lead-out patterns 231 and 232 facing the sixth surface 106 of the body 100, and a corresponding region of the lead-out patterns 231 and 232 may be ground by the dicing tip. As will be described later, the external electrodes 410 and 420 may be formed of a thin film that generally has relatively weak bonding force with the lead-out patterns 231 and 232. However, since a region exposed from the lower surface of the slit portions S1 and S2, among regions of the lead-out patterns 231 and 232, has a relatively high surface roughness, bonding force between the lead-out patterns 231 and 232 and the external electrodes 410 and 420 may be improved.

The lead-out patterns 231 and 232 and the auxiliary lead-out patterns 241 and 242 may be exposed from the end surfaces 101 and 102 of the body 100, respectively. For example, the first lead-out pattern 231 may be exposed from the first surface 101 of the body 100, and the second lead-out pattern 232 may be exposed from the second surface 102 of the body 100. The first auxiliary lead-out pattern 241 may be exposed from the first surface 101 of the body 100, and the second auxiliary lead-out pattern 242 may be exposed from the second surface 102 of the body 100. Due to this, the first lead-out pattern 231 may be exposed from the lower surface of the first slit portion S1 and the first surface 101 of the body 100, and the second lead-out pattern 232 may be exposed from the lower surface of the second slit portion S2 and the second surface 102 of the body 100.

At least one of the coil patterns 211 and 212, the connection via 220, the lead-out patterns 231 and 232, and the auxiliary lead-out patterns 241 and 242 may include one or more conductive layers 10 and 20. For example, when the first coil pattern 211, the lead-out patterns 231 and 232, and the connection via 220 are formed by plating on one surface of the support substrate IL, the first coil pattern 211, the lead-out patterns 231 and 232, and the connection via 220 may include a first conductive layer 10 formed by electroless plating or the like, and a second conductive layer 20 disposed on the first conductive layer 10. The first conductive layer 10 may be a seed layer for forming the second conductive layer 20 on the support substrate IL by plating. The second conductive layer 20 may be an electroplating layer. In this case, the electroplating layer may have a single-layer structure or a multilayer structure. The electroplating layer of the multilayer structure may be formed as a conformal film structure in which one electroplating layer is covered by the other electroplating layer, or may have a form in which the other electroplating layer is stacked on only one surface of the one electroplating layer. The seed layer of the first coil pattern 211 and the seed layer of the first lead-out pattern 231 may be integrally formed, with no boundary therebetween, but are not limited thereto. The electroplating layer of the first coil pattern 211 and the electroplating layer of the first lead-out pattern 231 may be integrally formed, with no boundary therebetween, but are not limited thereto.

The second conductive layer 20 may cover the first conductive layer 10 to contact the support substrate IL. For example, referring to FIG. 5, the first conductive layer 10 of the first coil pattern 211 may be formed to have a narrower width than the second conductive layer 20 of the first coil pattern 211, and the second conductive layer 20 of the pattern 211 may be formed to cover a surface of the first conductive layer 10 to be in contact with one surface of the support substrate IL. The structure of the first coil pattern 211 may be configured by forming a first conductive layer 10 having a planar spiral shape on the one surface of the support substrate IL, forming a plating resist having a planar spiral-shaped opening exposing the first conductive layer 10 on the one surface of the support substrate IL, and filling a second conductive layer 20 as an electroplating layer in the opening of the plating resist with the first conductive layer 10 as a seed layer. Since a diameter of the opening of the plating resist is greater than a line width of the first conductive layer 10, a line width of the second conductive layer 20 filling the opening of the plating resist may be larger than the line width of the first conductive layer 10. Therefore, the second conductive layer 20 may be in direct contact with one surface of the support substrate IL. In this embodiment, since the first plating layer 10, which may be a seed layer, is formed to have a planar spiral shape, and electroplating is then performed, removal of the plating resist and patterning of the seed layer may be omitted, compared to a case in which the seed layer may not be formed in a planar spiral shape and an electroplating layer may be formed. As a result, the number of processes may be reduced, and damage to the support substrate IL and conductor loss of the electroplating layer that may occur during the removal of the plating resist and the patterning of the seed layer may be prevented. At least a portion of the above-described plating resist may remain to be used as a portion of an insulating film IF to be described later.

The coil patterns 211 and 212, the lead-out patterns 231 and 232, and the auxiliary lead-out patterns 241 and 242 may be, for example, formed to protrude from the lower surface and the upper surface of the support substrate IL, as illustrated in FIGS. 4 and 5. As another example, the first coil pattern 211 and the lead-out patterns 231 and 232 may be formed to protrude from the lower surface of the support substrate IL, and the second coil pattern 212 and the auxiliary lead-out patterns 241 and 242 may be embedded in the upper surface of the substrate IL to be exposed from the upper surface of the support substrate IL. In this case, since a recess may be formed on at least one of the upper surface of the second coil pattern 212 and the upper surfaces of the auxiliary lead-out patterns 241 and 242, the upper surface of the support substrate IL and the upper surface of the second coil pattern 212, and/or the upper surfaces of the auxiliary lead-out patterns 241 and 242 may not be located on the same plane.

The coil patterns 211 and 212, the lead-out patterns 231 and 232, the auxiliary lead-out patterns 241 and 242, and the connection via 220 may be formed of a conductive material such as copper (Cu), aluminum (Al), silver (Ag), tin (Sn), gold (Au), nickel (Ni), lead (Pb), titanium (Ti), or alloys thereof, but are not limited thereto.

The first auxiliary lead-out pattern 241 may be independent of electrical connection of the remainder of the configuration of the coil portion 200, and may be thus omitted in this embodiment. In this case, a volume of a magnetic material in the body 100 may increase by a volume corresponding to the first auxiliary lead-out pattern 241. In order to omit a process of distinguishing the fifth surface 105 and the sixth surface 106 of the body 100, the first auxiliary lead-out pattern 241 may be formed, as illustrated in FIGS. 1 to 6.

The reinforcing pattern portions 311 and 312 may be disposed between the lead-out patterns 231 and 232 and one surface of the support substrate IL. The auxiliary reinforcing pattern portions 321 and 322 may be disposed between the auxiliary lead-out patterns 241 and 242 and the other surface of the support substrate IL. Specifically, the first reinforcing pattern portion 311 may be disposed between the first lead-out pattern 231 and one surface of the support substrate IL, and the second reinforcing pattern portion 312 may be disposed between the second lead-out pattern 232 and the one surface of the support substrate IL. The first auxiliary reinforcing pattern portion 321 may be disposed between the first auxiliary lead-out pattern 241 and the other surface of the support substrate IL, and the second auxiliary reinforcing pattern portion 322 may be disposed between the second auxiliary lead-out pattern 242 and the other surface of the support substrate IL. The above-described structures of the reinforcing pattern portions 311 and 312 and the auxiliary reinforcing pattern portions 321 and 322 may be implemented by first forming the reinforcing pattern portions 311 and 312 and the auxiliary reinforcing pattern portions 321 and 322, respectively, to one surface and the other surface of the support substrate IL, before forming the coil portion 200 on the support substrate IL.

It is advantageous because, as the support substrate is thinner, based on the body of the same size, volumes of the coil conductor and the magnetic material in the body may increase. When the support substrate becomes thin, it may be difficult to handle the support substrate during the process, and the possibility of deformation of the support substrate may increase. In particular, considering that a plurality of components are collectively formed by performing a manufacturing process in a massive scale, rather than in individual units, the above-described problems may be directly related to an increase in the defect rate. In the case of this embodiment, the above-described problems may be solved by forming the reinforcing pattern portions 311 and 312 and the auxiliary reinforcing pattern portions 321 and 322 on the support substrate IL. For example, by forming a width of each of the reinforcing pattern portions 311 and 312 and the auxiliary reinforcing pattern portions 321 and 322 larger than a width of the dicing line, a plurality of adjacent support substrates IL during the manufacturing process may be effectively supported. As a result, the support substrate IL may be more stably handled and supported in a subsequent process, to prevent deformation of the support substrate IL. Therefore, the support substrate IL may be relatively thin, and as a result, properties of the component may be improved. Hereinafter, in order to avoid overlapping description, descriptions will be made based on the reinforcing pattern portions 311 and 312, but the descriptions of the reinforcing pattern portions 311 and 312 may be applied to the auxiliary reinforcing pattern portions 321 and 322.

The reinforcing pattern portions 311 and 312 may have one surface thereof contacting the support substrate IL having a larger area than another surface thereof opposing the one surface. For example, based on the direction of FIG. 4, an area of an upper surface of each of the reinforcing pattern portions 311 and 312, contacting a lower surface of the support substrate IL, may be larger than an area of a lower surface of each of the reinforcing pattern portions 311 and 312, facing away from the support substrate IL and substantially parallel to the upper surface of the reinforcing pattern portion. Since the area of the upper surface of each of the reinforcing pattern portions 311 and 312 is made larger than the area of the lower surface of each of the reinforcing pattern portions 311 and 312, a function of the support substrate IL for supporting the reinforcing pattern portions 311 and 312 may be improved. Due to a difference in area between the upper and lower surfaces of the reinforcing pattern portions 311 and 312, one side surface of each of the reinforcing pattern portions 311 and 312 facing the first coil pattern 211 may have an inclination in the thickness direction T of the body 100, and as a result, a contact area between each of the reinforcing pattern portions 311 and 312 and each of the lead-out patterns 231 and 232 may increase. Therefore, bonding force between the reinforcing pattern portions 311 and 312 and the lead-out patterns 231 and 232 may be improved. A structure having a difference in area between the upper and lower surfaces of the reinforcing pattern portions 311 and 312 may be implemented, for example, by forming a metal film for forming the reinforcing pattern portions 311 and 312 on the one surface of the support substrate IL entirely, and removing a portion of the metal film, excluding the portion corresponding to the reinforcing pattern portions 311 and 312, by isotropic etching, but is not limited thereto. A copper clad laminate (CCL) may be used in the above-described method for forming the reinforcing pattern portions 311 and 312, but is not limited thereto.

A thickness of each of the reinforcing pattern portions 311 and 312 may be the same as a thickness of the support substrate IL. For example, when each of the reinforcing pattern portions 311 and 312 and the support substrate IL are formed by using a thick CCL having a 20 μm thick copper film respectively stacked on both surfaces of a 20 μm thick insulating material, a thickness of each of the reinforcing pattern portions 311 and 312 may be the same as a thickness of the support substrate IL.

A shape and a size of the reinforcing pattern portions 311 and 312 are not limited under a condition that the lead-out patterns 231 and 232 cover the reinforcing pattern portions 311 and 312. As the area and thickness of the reinforcing pattern portions 311 and 312 increase under the above-described condition, plating time for forming the lead-out patterns 231 and 232 may be advantageously reduced. Each of the reinforcing pattern portions 311 and 312 may have the other side surface, opposing the one side surface of each of the reinforcing pattern portions 311 and 312 facing the first coil pattern 211, respectively exposed from the first and second surfaces 101 and 102 of the body 100. The lead-out patterns 231 and 232 may cover all surfaces, except for the other side surfaces of the reinforcing pattern portions 311 and 312. In this case, the first conductive layers of the lead-out patterns 231 and 232 may cover all surfaces of the reinforcing pattern portions 311 and 312, except for the other sides of the reinforcing pattern portions 311 and 312.

The reinforcing pattern portions 311 and 312 and the auxiliary reinforcing pattern portions 321 and 322 may be connected to each other by through-vias TV1 and TV2 passing through the reinforcing pattern portions 311 and 312, the support substrate IL, and the auxiliary reinforcing pattern portions 321 and 322. For example, the first reinforcing pattern portion 311 and the first auxiliary reinforcing pattern portion 321 may be connected to each other by a first through-via TV1 passing through the first reinforcing pattern portion 311, the support substrate IL, and the first auxiliary reinforcing pattern portion 321, and the second reinforcing pattern portion 312 and the second auxiliary reinforcing pattern portion 322 may be connected to each other by a second through-via TV2 passing through the second reinforcing pattern portion 312, the support substrate IL, and the second auxiliary reinforcing pattern portion 322. Due to this structure, the lead-out patterns 231 and 232 respectively formed on the reinforcing pattern portions 311 and 312, and the auxiliary lead-out patterns 241 and 242 respectively formed on the auxiliary reinforcing pattern portions 321 and 322 may be electrically connected to each other, respectively.

The reinforcing pattern portions 311 and 312, the auxiliary reinforcing pattern portions 321 and 322, and the through-vias TV1 and TV2 may be formed of a conductive material such as copper (Cu), aluminum (Al), silver (Ag), tin (Sn), gold (Au), nickel (Ni), lead (Pb), titanium (Ti), or alloys thereof, but are not limited thereto.

As described above, when the first auxiliary lead-out pattern 241 is omitted in this embodiment, the first auxiliary reinforcing pattern portion 321 and the first through-via TV1 may also be omitted in this embodiment, but are not limited thereto. For example, although the first auxiliary lead-out pattern 241 is omitted in this embodiment, the first auxiliary reinforcing pattern portion 321 may not be formed on the other surface of the support substrate IL.

The external electrodes 410 and 420 may be disposed on the slit portions S1 and S2, respectively, and may be connected to the coil portion 200. Specifically, the first external electrode 410 may be disposed on an inner surface of the first slit portion S1, and may be connected to the first lead-out pattern 231 exposed from a lower surface of the first slit portion S1. The second external electrode 420 may be disposed on an inner surface of the second slit portion S2, and may be connected to the second lead-out pattern 232 exposed from a lower surface of the second slit portion S2. Each of the first external electrode 410 and the second external electrode 420 may extend to the sixth surface 106 of the body 100 to be spaced apart from each other thereon.

The external electrodes 410 and 420 may be formed along an inner wall of a respective one of the slit portions S1 and S2 and along the sixth surface 106 of the body 100. For example, the external electrodes 410 and 420 may be formed to have a form of a conformal film on the inner wall of the respective one of the slit portions S1 and S2 and on the sixth surface 106 of the body 100. The external electrodes 410 and 420 may be integrally formed on the inner wall of each of the slit portions S1 and S2 and the sixth surface 106 of the body 100. To this end, the external electrodes 410 and 420 may be formed by a thin film process such as a sputtering process or a plating process.

The external electrodes 410 and 420 may be formed of a conductive material such as copper (Cu), aluminum (Al), silver (Ag), tin (Sn), gold (Au), nickel (Ni), lead (Pb), chromium (Cr), titanium (Ti), or alloys thereof, but are not limited thereto.

The external electrodes 410 and 420 may be formed to have a single layer or multiple layers. For example, each of the external electrodes 410 and 420 may be formed to contact the lower surface of the respective one of the slit portions S1 and S2, the inner wall of the respective one of the slit portions S1 and S2, and the sixth surface 106 of the body 100, and may be formed to have a first layer of copper (Cu), a second layer of nickel (Ni) formed on the first layer, and a third layer of tin (Sn) formed on the second layer, but is not limited thereto.

The insulating film IF may insulate the lead-out patterns 231 and 232, the coil patterns 211 and 212, and the auxiliary lead-out patterns 241 and 242 from the body 100. The insulating layer IF may include, for example, parylene, but is not limited thereto. The insulating film IF may be formed by a vapor deposition method or the like, but is not limited thereto, and may also be formed by stacking an insulating film on both surfaces of the support substrate IL. The insulating film IF may be a structure including a portion of a plating resist used in forming the second plating layer by electroplating, but is not limited thereto.

A surface insulating layer 500 may be disposed on the surface of the body 100, and may cover portions of the external electrodes 410 and 420 respectively disposed on the inner surfaces of the slit portions S1 and S2. Specifically, the surface insulating layer 500 may be disposed on the inner surfaces of the slit portions S1 and S2, and the first to sixth surfaces 101, 102, 103, 104, 105, and 106 of the body 100, but may expose a portion of the sixth surface 106 of the external electrode 410 on which the external electrodes 410 and 420 are disposed. The surface insulating layer 500 may be formed by a printing process, a vapor deposition process, a spray coating process, a film stacking process, or the like, but is not limited thereto. The surface insulating layer 500 may include a thermoplastic resin such as a polystyrene-based resin, a vinyl acetate-based resin, a polyester-based resin, a polyethylene-based resin, a polypropylene-based resin, a polyamide-based resin, a rubber-based resin, an acrylic-based resin, and the like, a thermosetting resin such as a phenol-based resin, an epoxy-based resin, a urethane-based resin, a melamine-based resin, an alkyd-based resin, and the like, a photosensitive resin, parylene, $SiO_x$, or $SiN_x$. A portion of the surface insulating layer 500 may be formed on the body 100 before a process for forming the external electrodes 410 and 420 is carried out, and may function as a mask when forming the external electrodes 410 and 420, but is not limited thereto. The surface insulating layer 500 may be integrally formed, but may be formed by a plurality of processes, to form a boundary between a portion of a region in a surface of the body 100 and a portion formed on other regions.

By doing so, a coil component 1000 according to this embodiment may easily implement a lower electrode structure while reducing a size of the coil component. For example, since the external electrodes 410 and 420 may not be formed to protrude from both of the end surfaces 101 and 102 of the body 100 or both of the side surfaces 103 and 104 of the body 100, unlike a conventional method, overall length and width of the coil component 1000 may not increase. In addition, the external electrodes 410 and 420 are formed by a thin film process, and may be thus formed relatively thin, to minimize an increase in thickness of the coil component 1000. In addition, since the reinforcing pattern portions 311 and 312 and the auxiliary reinforcing pattern portions 321 and 322 are formed on the both surfaces of the of the support substrate IL, a coil component 1000 according to this embodiment may improve ease of handling of the support substrate IL during a manufacturing process and may prevent deformation of the support substrate IL.

Second Embodiment

Figure 7:
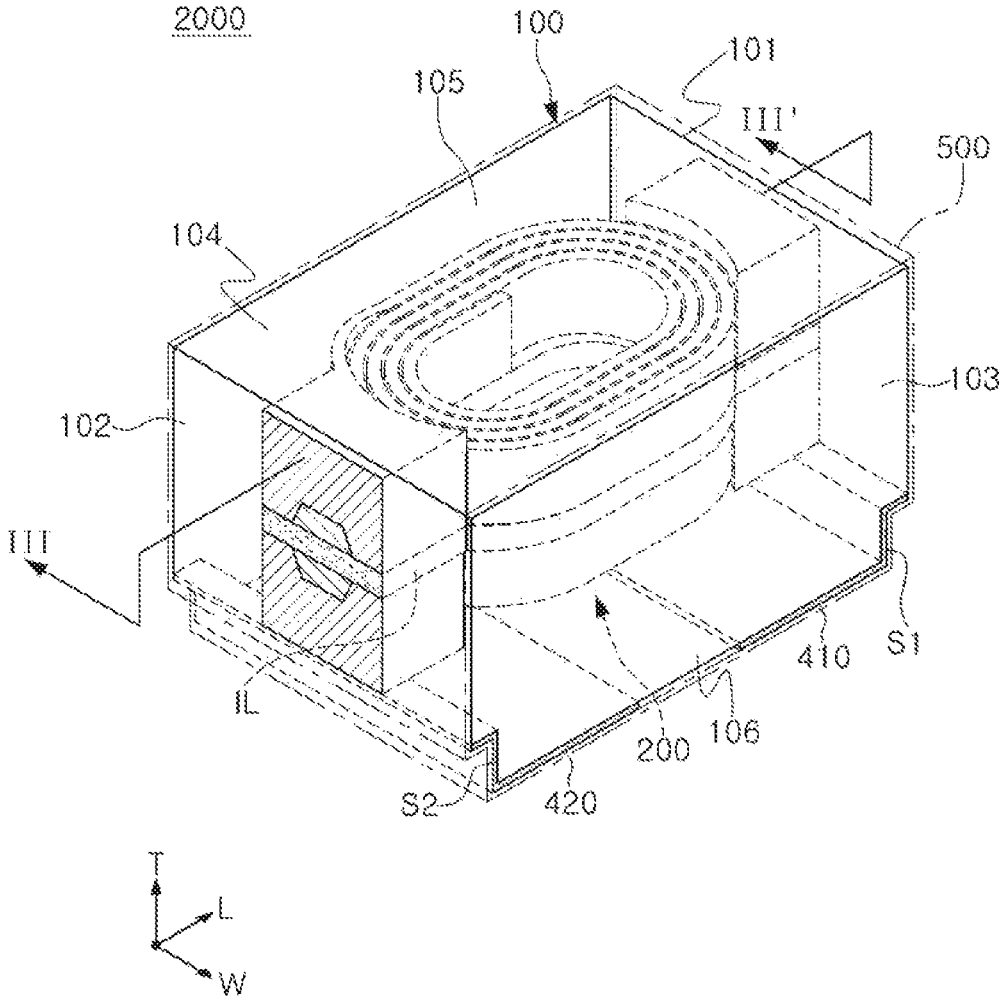
FIG. 7 is a view schematically illustrating a coil component according to a second embodiment of the present disclosure.
Figure 8:
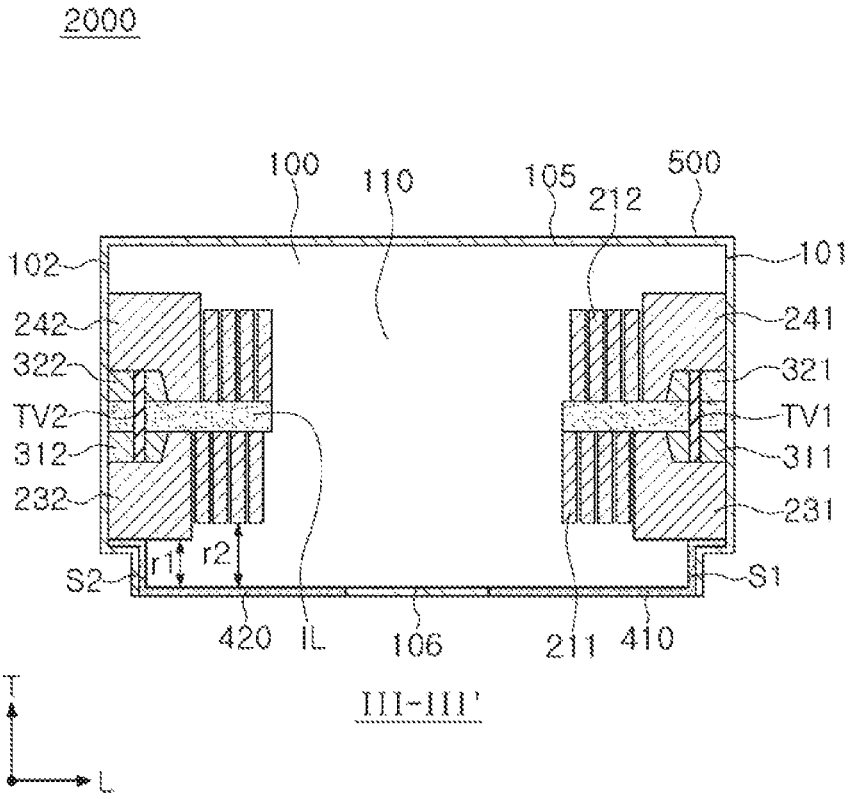
FIG. 8 is a view illustrating a cross-section taken along line of the coil component of FIG. 7.

FIG. 7 is a view schematically illustrating a coil component according to a second embodiment of the present disclosure. FIG. 8 is a view illustrating a cross-section taken along line of FIG. 7.

Referring to FIGS. 1 to 6 and FIGS. 7 to 8, when a coil component 2000 according to this embodiment is compared to the coil component 1000 according to the first embodiment of the present disclosure, lead-out patterns 231 and 232, and auxiliary lead-out patterns 241 and 242 may be differently provided. Therefore, in describing this embodiment, only the lead-out patterns 231 and 232 and the auxiliary lead-out patterns 241 and 242, different from the first embodiment, will be described. The remainder of the configuration of this embodiment may be applied as described in the first embodiment of the present disclosure.

In this embodiment, a distance (r1) from one surface of the body 100 to each of the lead-out patterns 231 and 232 may be shorter than a distance (r2) from the one surface of the body 100 to the first coil pattern 211. For example, a thickness of each of the lead-out patterns 231 and 232 may be thicker than a thickness of the first coil pattern 211. In this case, the thickness of each of the lead-out patterns 231 and 232 may refer to a distance from one surface of each of the lead-out patterns 231 and 232 contacting the support substrate IL to the other surface of each of the lead-out patterns 231 and 232 facing the sixth surface 106 of the body 100 in the vertical direction. The thickness of the first coil pattern 211 may refer to a distance from one surface of the first coil pattern 211 contacting the support substrate IL to the other surface of the first coil pattern 211 facing the sixth surface 106 of the body 100 in the vertical direction. In addition, the above-mentioned thickness and distance may refer to an average thickness and an average distance, respectively.

Due to the above-described structure, slit portions S1 and S2 may be formed at a relatively shallow depth, compared to the first embodiment of the present disclosure.

As described above, the slit portions S1 and S2 exposing the lead-out patterns 231 and 232 from the lower surface of the slit portions S1 and S2 may be formed by performing a pre-dicing process on the sixth surface 106 of the body 100. In the case of this embodiment, a volume of the body 100 to be removed during pre-dicing may be reduced due to the above-described structure of the lead-out patterns 231 and 232. Therefore, component characteristics may be improved by minimizing a reduction in amount of the magnetic material of the body 100.

The contents (e.g., thicknesses) of the above-described lead-out patterns 231 and 232 may also be applied to the auxiliary lead-out patterns 241 and 242, but are not limited thereto. For example, since the auxiliary lead-out patterns 241 and 242 are not configured to be exposed by the slit portions S1 and S2, the contents (e.g., thicknesses) of the lead-out patterns 231 and 232 described above may be selectively applied. Specifically, when the contents of the above-described lead-out patterns 231 and 232 are equally applied to the auxiliary lead-out patterns 241 and 242, in forming the slit portions S1 and S2, a process of distinguishing between the fifth surface 105 and the sixth surface 106 of the body 100 may be omitted. When the contents of the above-described lead-out patterns 231 and 232 are not applied to the auxiliary lead-out patterns 241 and 242, the auxiliary lead-out patterns 241 and 242 may not be formed relatively thickly, and thus, a volume of the magnetic material of the body 100 may increase.

Third Embodiment

Figure 9:
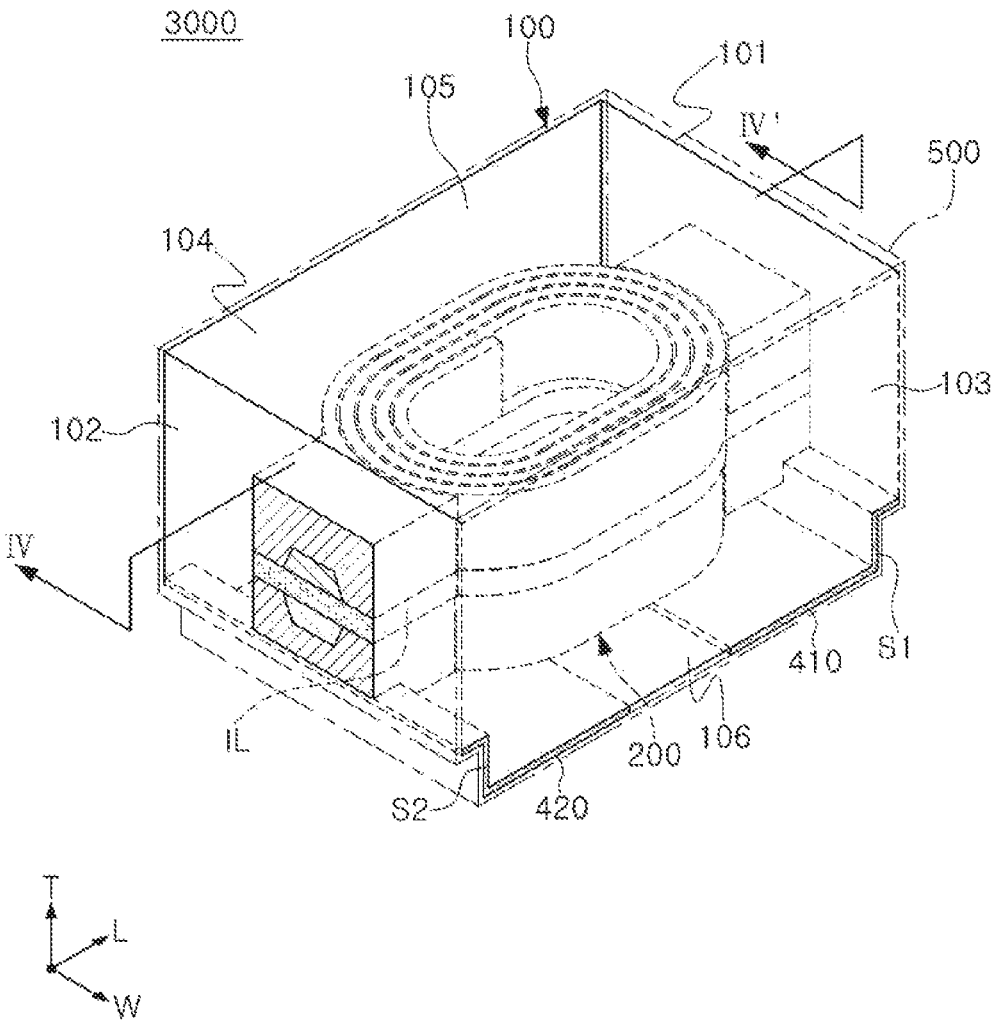
FIG. 9 is a view schematically illustrating a coil component according to a third embodiment of the present disclosure.
Figure 10:
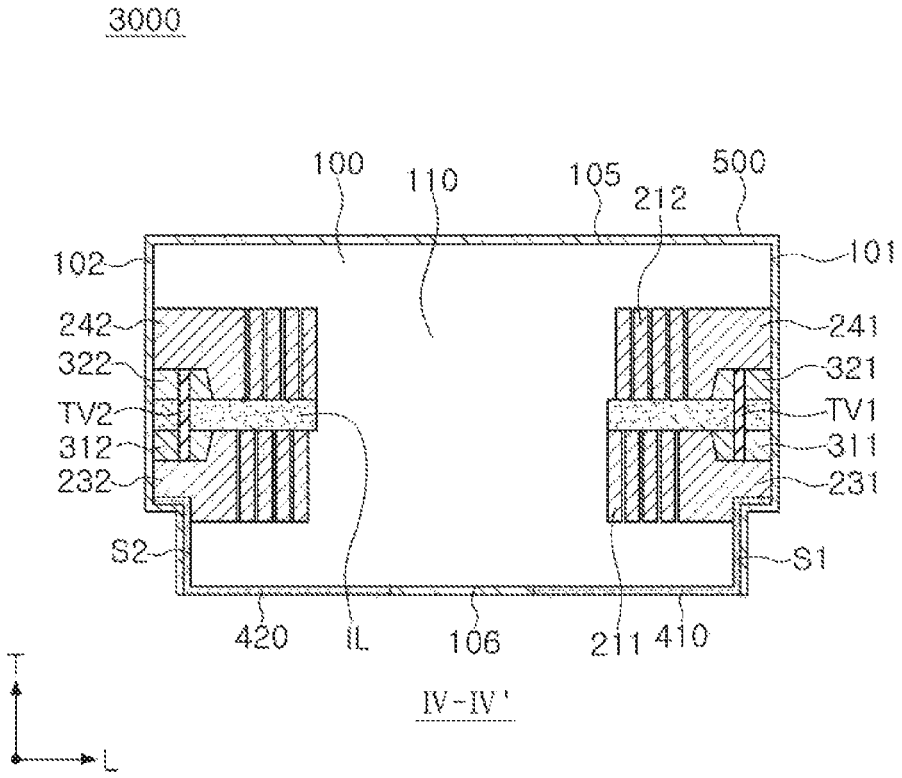
FIG. 10 is a view illustrating a cross-section taken along line IV-IV' of the coil component of FIG. 9.

FIG. 9 is a view schematically illustrating a coil component according to a third embodiment of the present disclosure. FIG. 10 is a view illustrating a cross-section taken along line IV-IV' of FIG. 9.

Referring to FIGS. 1 to 6 and 9 to 10, when a coil component 3000 according to this embodiment is compared to the coil component 1000 according to the first embodiment of the present disclosure, lead-out patterns 231 and 232 may be differently provided. Therefore, in describing this embodiment, only the form of the lead-out patterns 231 and 232, different from the first embodiment, will be described. The remainder of the configuration of this embodiment may be applied as described in the first embodiment of the present disclosure.

In this embodiment, the slit portions S1 and S2 may be formed to extend into a first lead-out pattern 231 and a second lead-out pattern 232, respectively. For example, the slit portions S1 and S2 may extend into at least a portion of the lead-out patterns 231 and 232. As a result, the first lead-out pattern 231 may be exposed from a lower surface and an inner wall of the first slit portion S1, and the second lead-out pattern 232 may be exposed from a lower surface and an inner wall of the second slit portion S2. Due to the presence of the slit portions S1 and S2, the lead-out patterns 231 and 232 may be formed such that a thickness of a region forming the lower surfaces of the slit portions S1 and S2 is different from a thickness of a region forming the inner walls of the slit portions S1 and S2, to have a step difference from each other as a whole.

In this embodiment, since the lead-out patterns 231 and 232 may be exposed not only from the lower surfaces of the slit portions S1 and S2, but also from the inner walls of the slit portions S1 and S2, bonding force between the lead-out patterns 231 and 232 and the external electrodes 410 and 420 may increase by an increase in contact area therebetween.

Fourth Embodiment

Figure 11:
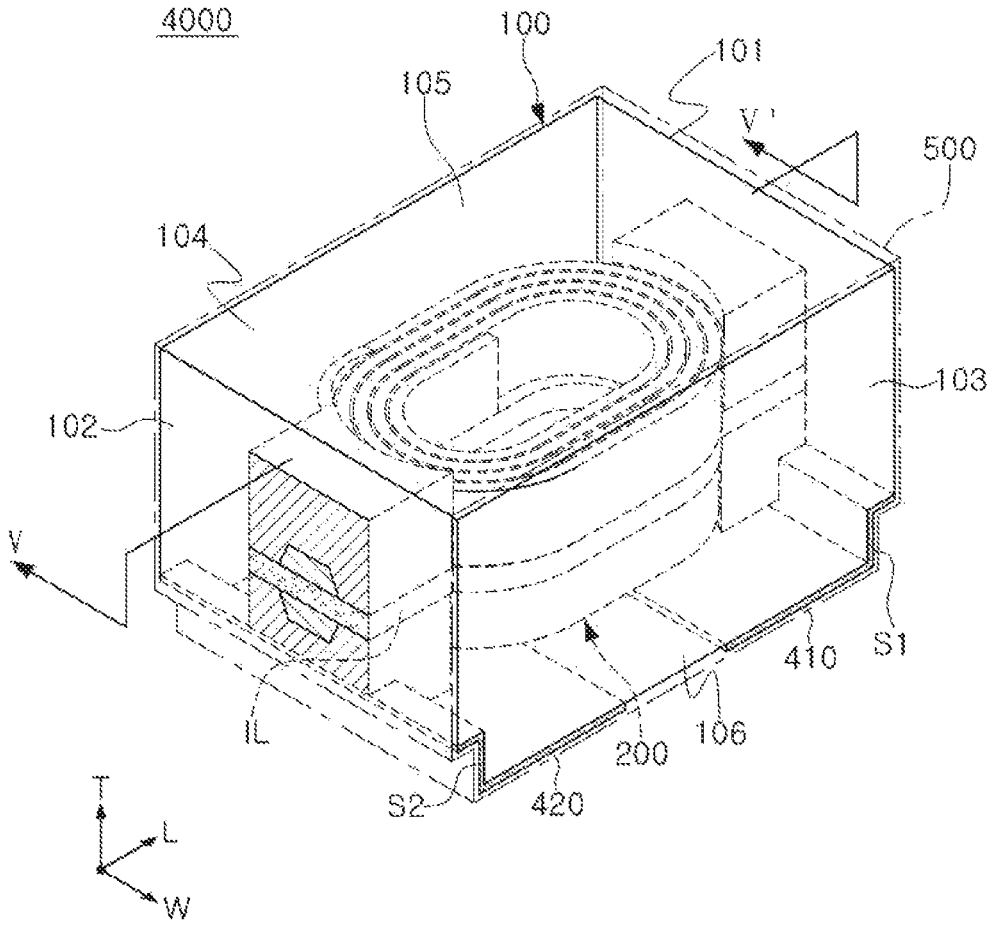
FIG. 11 is a view schematically illustrating a coil component according to a fourth embodiment of the present disclosure.
Figure 12:
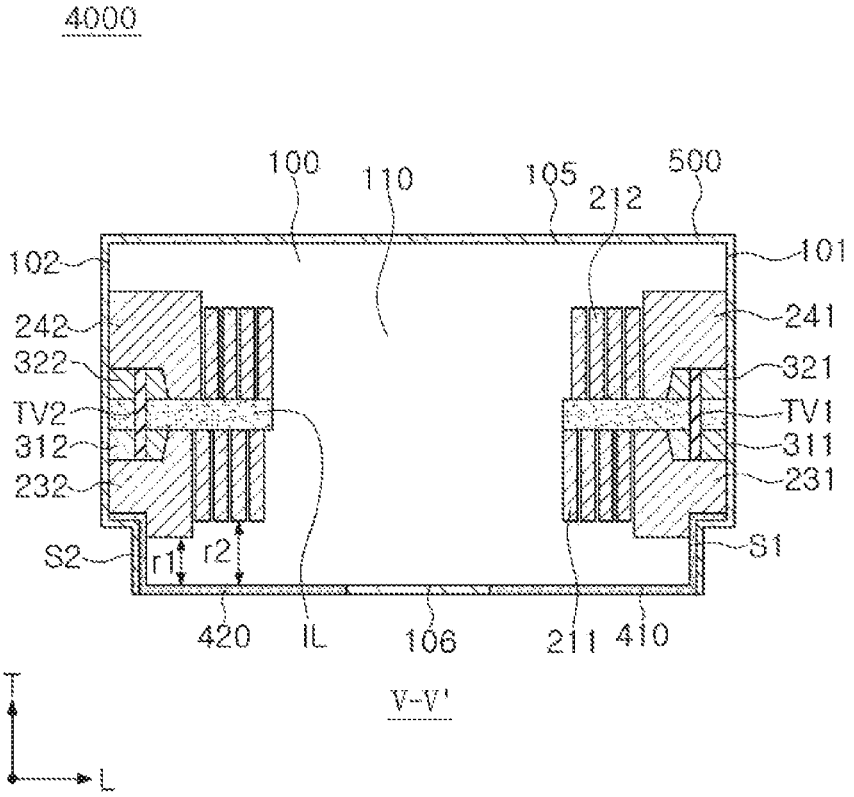
FIG. 12 is a view illustrating a cross-section taken along line V-V' of the coil component of FIG. 10.

FIG. 11 is a view schematically illustrating a coil component according to a fourth embodiment of the present disclosure. FIG. 12 is a view illustrating a cross-section taken along line V-V' of FIG. 10.

Referring to FIGS. 7 to 8 and 11 to 12, when a coil component 4000 according to this embodiment is compared to the coil component 2000 according to the second embodiment of the present disclosure, lead-out patterns 231 and 232 may be differently provided. Therefore, in describing this embodiment, only the lead-out patterns 231 and 232, different from the second embodiment, will be described. The remainder of the configuration of this embodiment may be applied as described in the second embodiment of the present disclosure.

In this embodiment, the slit portions S1 and S2 may be formed to extend into a first lead-out pattern 231 and a second lead-out pattern 232, respectively. For example, the slit portions S1 and S2 may extend into at least a portion of the lead-out patterns 231 and 232. As a result, the first lead-out pattern 231 may be exposed from a lower surface and an inner wall of the first slit portion S1, and the second lead-out pattern 232 may be exposed from a lower surface and an inner wall of the second slit portion S2. Due to the presence of the slit portions S1 and S2, the lead-out patterns 231 and 232 may be formed such that a thickness of a region forming the lower surfaces of the slit portions S1 and S2 is different from a thickness of a region forming the inner walls of the slit portions S1 and S2, to have a step difference from each other as a whole.

In the case of this embodiment, an effect of the coil component 2000 according to the second embodiment of the present disclosure and an effect of the coil component 3000 according to the third embodiment of the present disclosure may be provided. For example, in the case of this embodiment, as in the coil component 3000 according to the third embodiment of the present disclosure, bonding force between the lead-out patterns 231 and 232 and the external electrodes 410 and 420 may be increased. Further, like the coil component 2000 according to the second embodiment of the present disclosure, reduction of the magnetic material of the body 100 may be minimized.

In the case of this embodiment, a distance (r1) from one surface of the body 100 to the lead-out patterns 231 and 232 and a thickness of the lead-out patterns 231 and 232 may refer to a distance (r1) and a thickness of the lead-out patterns 231 and 232, based on only regions in which the slit portions S1 and S2 are not formed, unlike the second embodiment of the present disclosure. For this reason, the average distance from one surface of the body 100 and the average thickness of the lead-out patterns 231 and 232 to the lead-out patterns 231 and 232, described in the second embodiment of the present disclosure, may be based on only a portion of the above-described lead-out patterns 231 and 232.

According to embodiments of the present disclosure, a support substrate may be more stably supported during a manufacturing process.

In addition, according to embodiments of the present disclosure, loss of a body may be minimized.

While example embodiments have been illustrated and described above, it will be apparent to those skilled in the art that modifications and variations could be made without departing from the scope of the present disclosure as defined by the appended claims.

What is claimed is:

1. A coil component comprising:

a body having one surface and another surface opposing each other;

a support substrate disposed in the body;

a coil portion including a first coil pattern disposed on one surface of the support substrate facing the one surface of the body, a first lead-out pattern extending from the first coil pattern to an end surface of the body, and a second lead-out pattern disposed on the one surface of the support substrate to be spaced apart from the first coil pattern and extending to another end surface of the body;

a reinforcing pattern portion disposed between each of the first and second lead-out patterns and the one surface of the support substrate;

first and second slit portions respectively disposed in edge portions of the one surface of the body and respectively exposing the first and second lead-out patterns from inner surfaces of the first and second slit portions; and first and second external electrodes respectively disposed on the inner surfaces of the first and second slit portions and respectively connected to the first and second lead-out patterns, wherein each of the reinforcing pattern portions is spaced apart from the first coil pattern.

2. The coil component according to claim 1, wherein a distance from the one surface of the body to each of the first and second lead-out patterns is shorter than a distance from the one surface of the body to the first coil pattern.

3. The coil component according to claim 1, wherein an area of one surface of at least one of the reinforcing pattern portions contacting the support substrate is larger than an area of another surface of the at least one of the reinforcing pattern portions opposing the one surface of the at least one of the reinforcing pattern portions.

4. The coil component according to claim 1, wherein a thickness of at least one of the reinforcing pattern portions is the same as a thickness of the support substrate.

5. The coil component according to claim 1, wherein each of the first and second lead-out patterns covers one side surface of the reinforcing pattern portion facing the first coil pattern, and contacts the one surface of the support substrate.

6. The coil component according to claim 5, wherein each of the reinforcing pattern portions is exposed from a respective end surface of the body.

7. The coil component according to claim 1, wherein the first and second slit portions are formed to extend to contact at least a portion of the first and second lead-out patterns, respectively.

8. The coil component according to claim 1, wherein each of the first coil pattern, the first lead-out pattern, and the second lead-out pattern includes a first conductive layer and a second conductive layer disposed on the first conductive layer, wherein the second conductive layer covers the first conductive layer and contacts the one surface of the support substrate.

9. The coil component according to claim 8, wherein the first conductive layer of each of the first and second lead-out patterns covers the reinforcing pattern portion.

10. The coil component according to claim 1, wherein the coil portion further comprises:

a second coil pattern disposed on another surface of the support substrate opposing the one surface of the support substrate, a first auxiliary lead-out pattern disposed on the another surface of the support substrate to be spaced apart from the second coil pattern and overlap with the first lead-out pattern, a second auxiliary lead-out pattern disposed on the another surface of the support substrate to extend from the second coil pattern and overlap with the second lead-out pattern, a connection via passing through the support substrate to connect the first coil pattern and the second coil pattern, and an auxiliary reinforcing pattern portion disposed between each of the first and second auxiliary lead-out patterns and the another surface of the support substrate.

11. The coil component according to claim 10, wherein the second lead-out pattern and the second auxiliary lead-out pattern are connected to each other by a through-via passing through the reinforcing pattern portion, the support substrate, and the auxiliary reinforcing pattern portion.

12. A coil component comprising:

a body having one surface and another surface opposing each other;

a support substrate disposed in the body;

a coil portion including a first coil pattern disposed on one surface of the support substrate facing the one surface of the body, a first lead-out pattern extending from the first coil pattern to an end surface of the body, and a second lead-out pattern disposed on the one surface of the support substrate to be spaced apart from the first coil pattern and extending to another end surface of the body;

a reinforcing pattern portion disposed between the first lead-out pattern and the one surface of the support substrate;

first and second slit portions respectively formed in edge portions of the one surface of the body and respectively exposing the first and second lead-out patterns from inner surfaces of the first and second slit portions; and first and second external electrodes respectively disposed on the inner surfaces of the first and second slit portions and respectively connected to the first and second lead-out patterns, wherein a thickness of each of the first and second lead-out patterns is greater than a thickness of the first coil pattern, and wherein the reinforcing pattern portion is spaced apart from the first coil pattern.

13. The coil component of claim 12, wherein a distance from the one surface of the body to each of the first and second lead-out patterns is shorter than a distance from the one surface of the body to the first coil pattern.

14. The coil component of claim 12, the first and second slit portions extend to a depth from the one surface of the body greater than a distance from the one surface of the body to each of the first and second lead-out patterns.

15. A coil component comprising:

a body;

a support substrate disposed in the body;

a coil portion including a first coil pattern disposed on one surface of the support substrate, and first and second lead-out patterns extending between the first coil pattern and respective end surfaces of the body; and first and second reinforcing pattern portions formed of a conductive material, the first reinforcing pattern portion disposed between the one surface of the support substrate and only the first lead-out pattern, from among the first lead-out pattern and the first coil pattern, and the second reinforcing pattern portion disposed between the one surface of the support substrate and only the second lead-out pattern, from among the second lead-out pattern and the first coil pattern.

16. The coil component of claim 15, wherein the first and second reinforcing pattern portions each have a surface facing the first coil pattern that is sloped so as to be non-orthogonal to the one surface of the substrate.

17. The coil component of claim 15, further comprising first and second through-vias each extending through the support substrate and a respective one of the first and second reinforcing pattern portions to directly contact a respective one of the first and second lead-out patterns.

18. The coil component of claim 15, wherein a thickness of each of the first and second reinforcing pattern portions is equal to a thickness of the support substrate.

19. The coil component of claim 15, wherein a surface of the body facing the one surface of the support substrate has first and second slit portions each disposed along a respective end surface of the body and each extending to a respective one of the first and second lead-out patterns, and first and second external electrodes are spaced apart from each other on the surface of the body facing the one surface of the support substrate, and respectively extend in the first and second slit portions to contact the first and second lead-out patterns.

20. The coil component of claim 15, wherein a distance from one surface of the body facing the one surface of the support substrate to each of the first and second lead-out patterns is shorter than a distance from the one surface of the body to the first coil pattern.

* * * * *